US006918495B1

(12) United States Patent
Hoy

(10) Patent No.: US 6,918,495 B1
(45) Date of Patent: Jul. 19, 2005

(54) TOOTHBRUSH HOLDER

(75) Inventor: Michael W. Hoy, 2917 Poplar St., Naples, FL (US) 34112

(73) Assignee: Michael W. Hoy, Naples, FL (US)

( * ) Notice: Subject to any disclaimer, the term of this patent is extended or adjusted under 35 U.S.C. 154(b) by 0 days.

(21) Appl. No.: 10/766,268

(22) Filed: Jan. 29, 2004

(51) Int. Cl.[7] ..... A47B 81/02
(52) U.S. Cl. ..... 211/66
(58) Field of Search ..... 211/66, 65, 13.1, 211/119.009; 248/110; D6/528

(56) References Cited

U.S. PATENT DOCUMENTS 2,916,155 A * 12/1959 Elliott ..... 211/65
4,008,808 A * 2/1977 Ramsay ..... 211/65
5,259,519 A * 11/1993 Lieberman ..... 211/66
6,402,104 B1 * 6/2002 Smith ..... 248/205.5
6,457,592 B1 * 10/2002 Rozen ..... 211/65
6,786,342 B2 * 9/2004 Tayebi ..... 211/65

* cited by examiner

*Primary Examiner*—Peter M. Cuomo
*Assistant Examiner*—Sarah Purol
(74) *Attorney, Agent, or Firm*—Werner Schroeder

(57) ABSTRACT

There is disclosed a toothbrush holder system that consists of three basic parts. There is a wall mounted box-type receiver that receives a second L-shaped unit with a downwardly depending element and a third clamping element retainer the second element within the box-type receiver. The L-shaped unit includes a horizontally extending extension having receptacles therein for receiving toothbrushes. The L-shaped unit has a vertically depending element that is removably being clamped within the wall mounted box-type receiver that. The L-shaped unit can easily be separated from the box-type receiver. It is normally encased in a sanitized wrapper and is only installed when new residents occupy a previously vacated bathroom in a motel or hotel. In this manner, the toothbrush itself is always protected from any bacteria present on the toothbrush holders present in any commercial establishments.

8 Claims, 3 Drawing Sheets

TOOTHBRUSH HOLDER

CROSS REFERENCE TO RELATED APPLICATIONS (none)

STATEMENT REGARDING FED SPONSORED R & D (none)

BACKGROUND OF THE INVENTION

The inventive tooth brush holder is especially designed and to be used in public locations such as hotels, motels and other locations where a frequent brushing of teeth takes place. It is a well known fact that the above noted locations have tooth brush holders in their bath rooms but they are not sanitary at all. They may frequently be cleaned but not in any sanitary manner. That is, the cleaning cloths may leave a certain amount of bacteria behind, which can only be removed by boiling water or by steam or by special chemicals designed for this purpose. Therefore, the next person using the tooth brush holder and placing his/her tooth brush into the existing tooth brush holder may pick up the bacteria from the existing tooth brush holder. This is highly undesirable and may lead to a transfer of illnesses or viral infections from one person to another.

An object of the invention therefore is, to assure that every person using a bathroom in a hotel or motel and has a need to brush his or her teeth will have a sanitary tooth brush holder available.

DETAILED DESCRIPTION OF THE INVENTION

Figure 2:
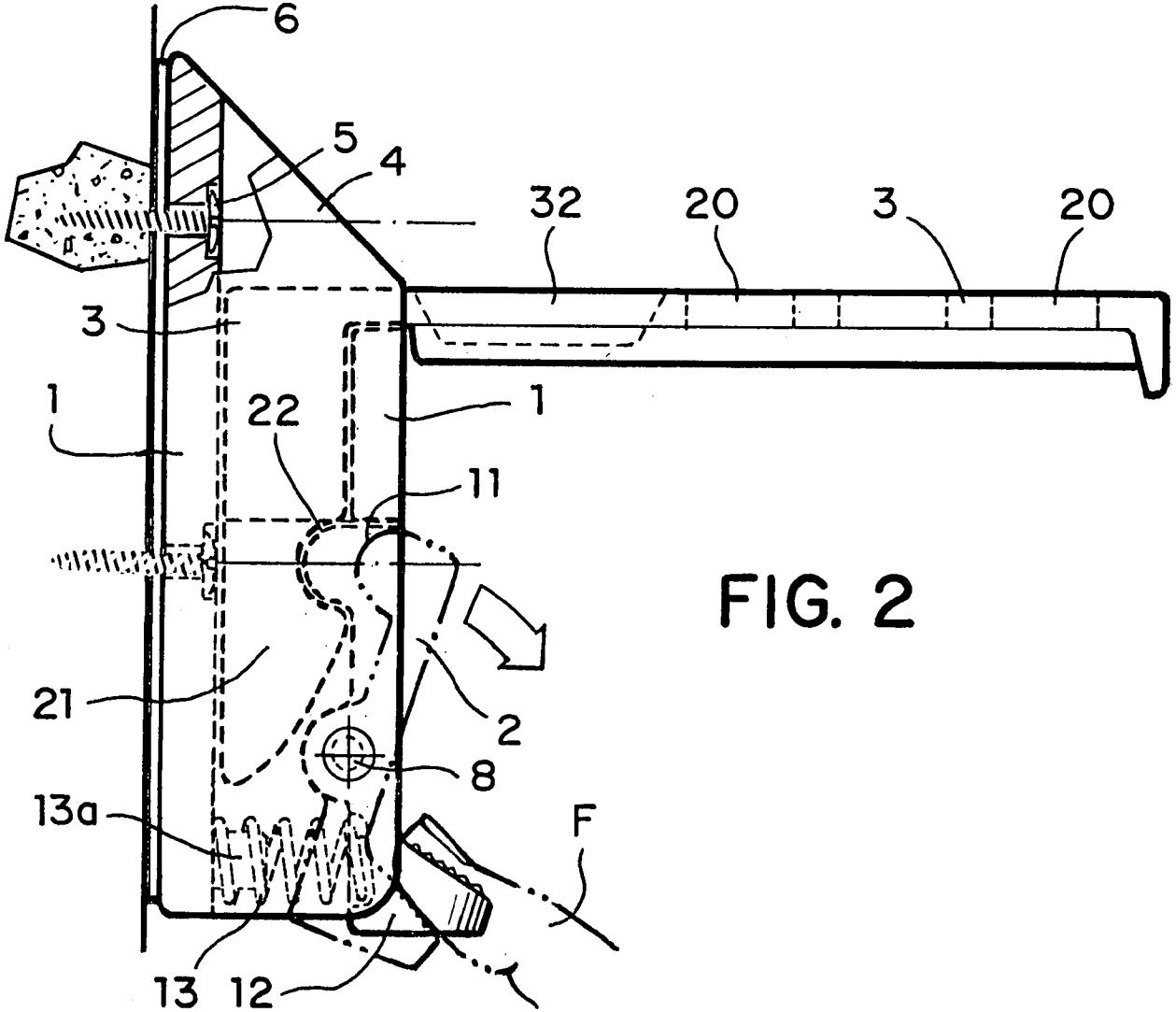
FIG. 2 is a side view of the tooth brush holder in an assembled form.

The basic tooth brush holder consists of three major parts. 1 is the basic wall mount unit, 2 is a clamping element that clamps the tooth brush holder 3 within the wall mount unit 1. The basic wall mount unit is a hollow and rectangular receptacle. It has a hollow upper interior 4 and a lower hollow interior 7. This unit should be mounted in a bathroom of the hotel or motel in a convenient location, that is, close to the wash basin. It can be mounted by of a screw 5 through a hole 5*a* including a second screw mount 15 (FIG. 2). The basic unit can also be mounted on a wall by way of an adhesive layer 6. The bottom hollow interior 7 receives the clamping element 2 and is held therein by way of a pin 8 that passes completed through the basic unit 1 and is held therein by way of a fastener 8*a*. The pin 8 also passes through the clamping element 2, that is, through the opening 10. Once the basic unit is installed it is held therein in a pivotal manner. The pivoting action is being restrained by the compression spring 13 which is interposed between a rear wall 7 of the lower interior hollow 7 and the back wall of the clamping element 2. A stud 13*a* is placed on the rear wall to keep the compression spring 13 in alignment for its intended purpose and, that is, to keep a constant bias of the spring 13 so that the clamping element 2 is always pushed inwardly toward the rear wall of the receptacle 1 which will be explained by having reference to FIG. 2.

Figure 1:
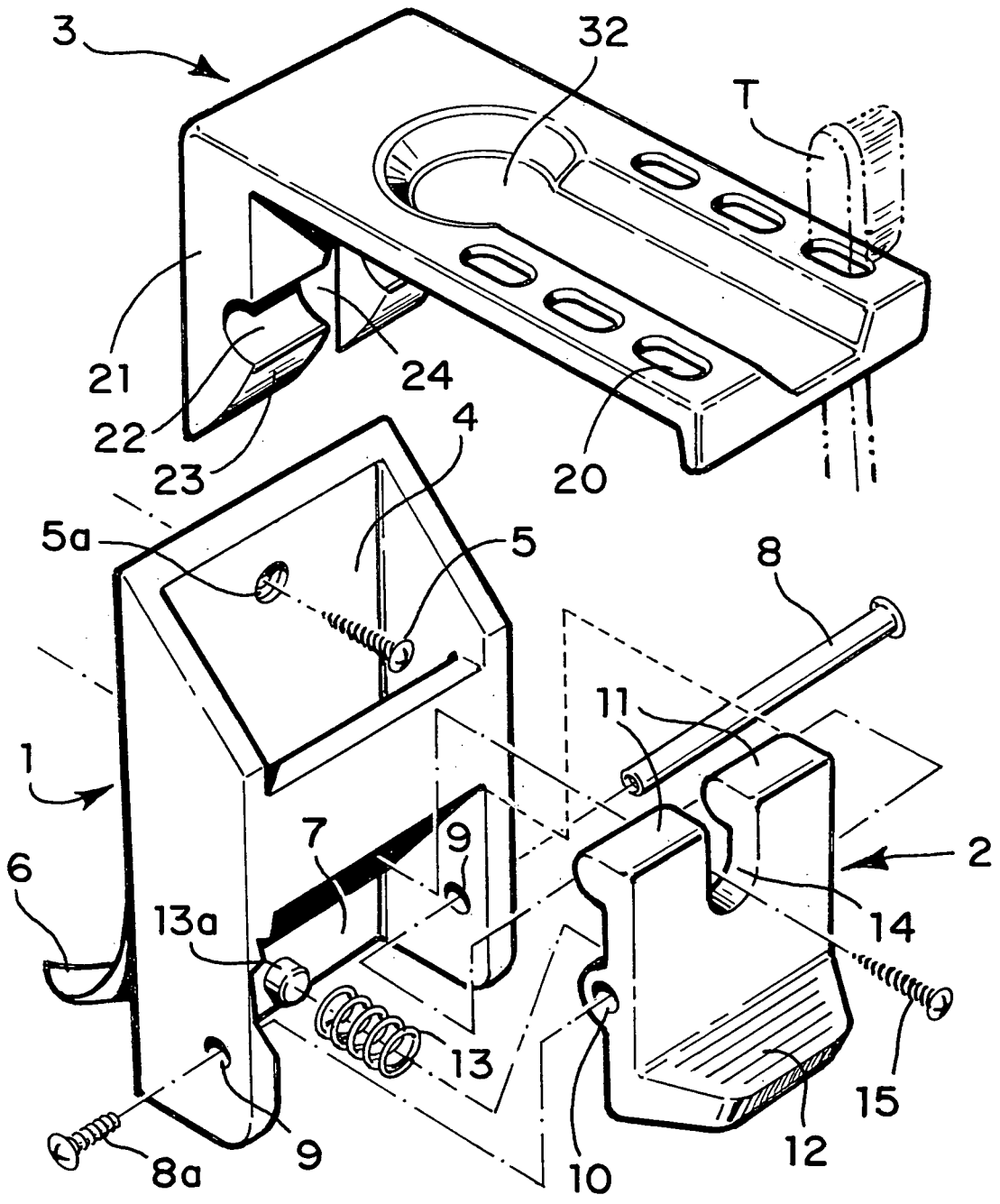
FIG. 1 is an exploded and perspective view of the various parts of the tooth brush holder.

FIG. 2 is a side view of the assembled tooth brush holder. It should be noted that the same reference characters have been used with reference to FIG. 1. In this FIG. 2, it can be seen that the clamping element can be activated against the bias of the compression spring 13 by pushing on the finger grip 12 by way of the finger F, for example. The movable clamping element 2 has at an upper end thereof a bulging protrusion which is designed to settle into a like-shaped recess 22 located in a lower section of the removable unit 3.

The removable unit 3 is formed into an L-shaped configuration with a horizontal section forming a support for tooth brushes and a vertical section forming the fastening section so it can be retained within the wall mounted receptacle. The lower end of the vertical section has a chamfered area 21 so that when the vertical section 21 is pushed into the wall mounted receptacle, the chamfered area 21 will push or cam the protrusion out of its way until it can firmly settle within the recess 22 to be firmly locked therein. To remove the removable holder 3, the finger grip 12 will have to be activated by the finger F to thereby rotate the protrusion 11 out of the recess 22 to thereby free the vertical 21 and the tooth brush holder 3 can be removed from the mounted unit 1 by an upward movement.

Figure 3:
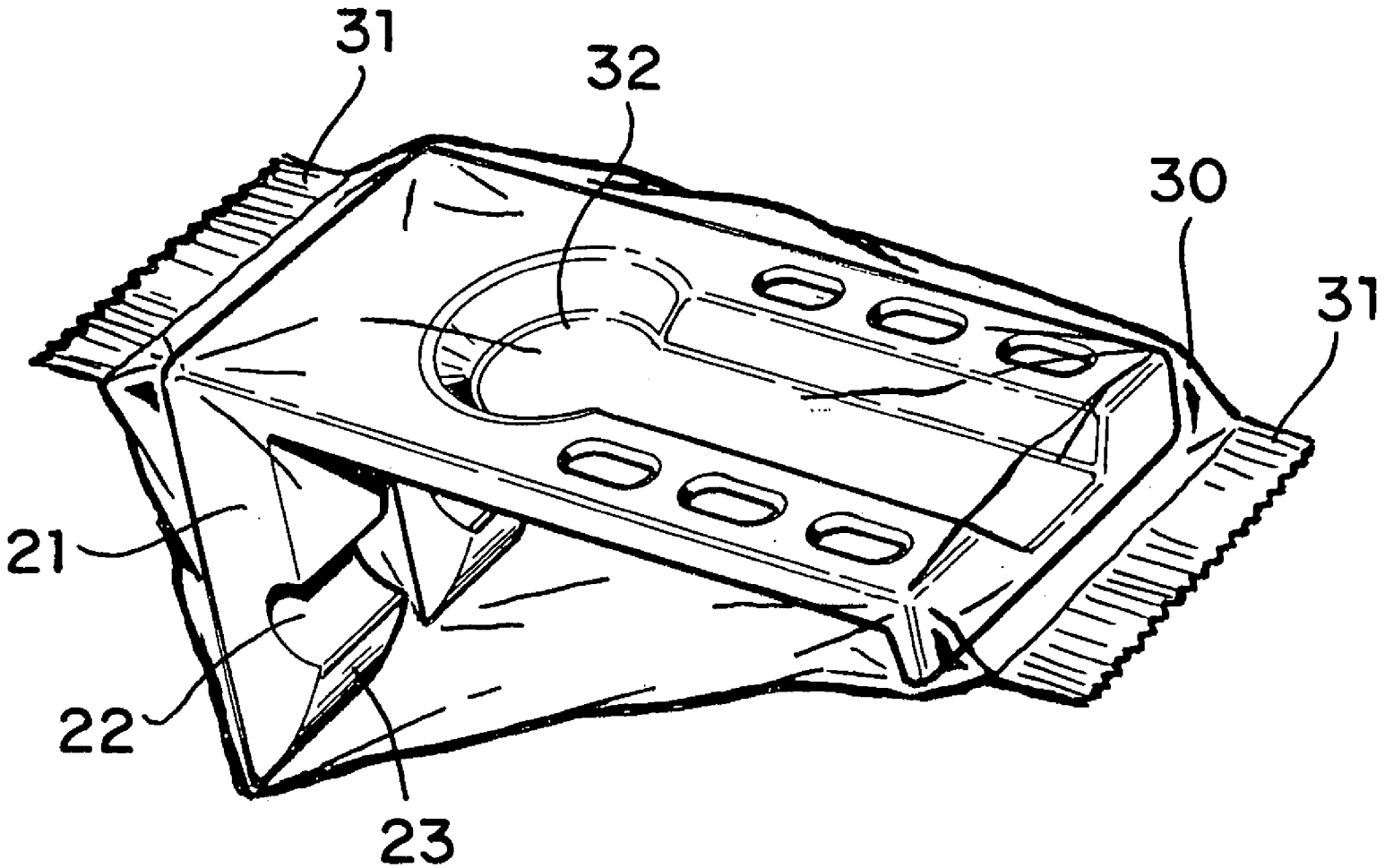
FIG. 3 is a part of the tooth brush holder that will be in contact with a tooth brush when placed therein in a sanitary package.

FIG. 3 illustrates the removable holder 3 in a state prior to being installed in the wall mounting unit 1. As can be seen, like reference characters have been used to identify like elements of previous Figs. As can be seen, the removable holder 3 is encased in a clear view sanitary casing 30 and it is sealed at its ends by a sealing formation 31. This is the way an occupant of the room should find the removable holder 3. It is now up to the occupant to break the sanitary casing 30 and to remove it and then to push the vertical 21 of the holder into the wall mount 1 until it is clamped by the protrusion 11 in the recess 22. The assembled unit is now ready for use. When the occupant leaves the premises he/she can take the removable holder 3 with him/her. If not, the removable unit can be left in place and the service personnel will take it away and leave a sanitized and wrapped unit in place for the next occupant.

What is claimed is:

1. A toothbrush holder system consisting of three parts; a wall mounted retainer device, a clamping unit and a toothbrush retainer unit, said wall mounted unit is a hollow box-like retainer having an upper and a lower cavity therein, said upper cavity is adapted to receive part of an L-shaped element of said toothbrush retainer unit therein, said lower cavity receiving said clamping unit therein, means for mounting said clamping unit in said lower cavity in a pivotal manner for clamping said part of said L-shaped element in said lower cavity.

2. The toothbrush holder system of claim 1, wherein said wall mounted retainer device includes means for mounting said device against a wall.

3. The toothbrush element of claim 1, including means for sanitary enclosing said toothbrush retainer when not engaged in said wall retainer.

4. The toothbrush holder system of claim 1, wherein said L-shaped element of said toothbrush retainer is a vertically depending element which moves downwardly into said upper cavity of said box-like retainer and further has a horizontal element extending therefrom that receives toothbrushes therein.

5. The toothbrush holder of claim 4 including cam means on a bottom of said vertically depending element for camming said depending element into engagement with said clamping unit when pushed into said upper cavity.

6. The toothbrush holder system of claim 4, wherein said vertically depending element has a depression therein.

7. The toothbrush holder system of claim 6, wherein said clamping unit has an upper protrusion thereon to mate with said depression of said vertically depending element.

8. The toothbrush holder of claim 7 including biasing means for moving said clamping unit into a clamping engagement with said vertically depending element.

* * * * *